US011946693B2

(12) United States Patent
Bastid

(10) Patent No.: US 11,946,693 B2
(45) Date of Patent: Apr. 2, 2024

(54) SYSTEM FOR CONTROLLING AN ARGON FLOW RATE AT THE OUTLET OF A DISTILLATION COLUMN

(71) Applicant: L'Air Liquide, Societe Anonyme pour l'Etude et l'Exploitation des Procedes Georges Claude, Paris (FR)

(72) Inventor: Marc Bastid, Paris (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 473 days.

(21) Appl. No.: 17/253,583

(22) PCT Filed: May 22, 2019

(86) PCT No.: PCT/FR2019/051169
§ 371 (c)(1),
(2) Date: Dec. 17, 2020

(87) PCT Pub. No.: WO2019/243681
PCT Pub. Date: Dec. 26, 2019

(65) Prior Publication Data

US 2021/0222949 A1 Jul. 22, 2021

(30) Foreign Application Priority Data

Jun. 22, 2018 (FR) ..... 1855605

(51) Int. Cl.
*F25J 3/04* (2006.01)

(52) U.S. Cl.
CPC ..... *F25J 3/04412* (2013.01); *F25J 3/04678* (2013.01); *F25J 3/04848* (2013.01)

(58) Field of Classification Search
CPC ..... F25J 3/04412; F25J 3/048; F25J 3/04848; F25J 3/04678
See application file for complete search history.

(56) References Cited

U.S. PATENT DOCUMENTS 5,590,544 A 1/1997 Corduan et al.
2013/0053998 A1* 2/2013 Singhal ..... F25J 3/04303 700/108
2018/0292130 A1* 10/2018 Prosser ..... F25J 3/04969

FOREIGN PATENT DOCUMENTS

EP 0 669 509 8/1995
EP 0 701 186 3/1996
(Continued)

OTHER PUBLICATIONS

International Search Report and Written Report for PCT/FR20019/051169, dated Sep. 30, 2019.
(Continued)

*Primary Examiner* — Frantz F Jules
*Assistant Examiner* — Webeshet Mengesha
(74) *Attorney, Agent, or Firm* — Justin K. Murray

(57) ABSTRACT

The invention relates to a system for controlling an argon flow rate of a fluid at the outlet of an assembly of at least one distillation column in order to reach a target dioxygen level (SP). The system comprises: a sensor arranged so as to measure a dioxygen level (PV) in a fluid containing argon at the outlet of the assembly of at least one distillation column; a regulator arranged so as to determine a required argon flow rate variation ($\Delta_{regul}$) according to the difference between the dioxygen level measured by the sensor and a target dioxygen level; a controller arranged so as to generate a control signal relating to a targeted argon flow rate, said targeted argon flow rate being determined according to the required argon flow variation determined by the regulator and variations in the dioxygen level measured by the sensor; and a valve, controlled by said controller, which is arranged so as to modify the argon flow rate of the fluid at the outlet of at least one distillation column in order to achieve the targeted argon flow rate.

16 Claims, 6 Drawing Sheets

(56) References Cited

FOREIGN PATENT DOCUMENTS

| | | |
|---|---|---|
| EP | 1 522 808 | 4/2005 |
| JP | H08152261 | 6/1996 |
| JP | 3451453 | 9/2003 |

OTHER PUBLICATIONS

Schmidt, et al., "Dynamic Design of a Cryogenic Air Separation Unit," Jan. 1, 2013, pp. 1-41. Retrieved from Internet: http://www3.aiche.org/proceedings/content/Annual-2013/extended-abstracts/P320892.pdf (retrieved on Mar. 4, 2015).

* cited by examiner

SYSTEM FOR CONTROLLING AN ARGON FLOW RATE AT THE OUTLET OF A DISTILLATION COLUMN

CROSS REFERENCE TO RELATED APPLICATIONS

This application is a § 371 of International PCT Application PCT/FR2019/051169, filed May 22, 2019, which claims the benefit of FR1855605, filed Jun. 22, 2018, both of which are herein incorporated by reference in their entireties.

FIELD OF THE INVENTION

The field of the invention relates to the control of an argon flow rate at the outlet of a distillation column. In particular, the modification of the argon flow rate of a fluid at the outlet of a distillation column makes it possible to modify the dioxygen content of this fluid and thus to improve its argon purity. The distillation is performed at cryogenic temperatures.

BACKGROUND OF THE INVENTION

Distillation is a process for separating the different constituents of a homogeneous liquid mixture. Specifically, these constituents generally have distinct boiling temperatures (or vaporization temperatures) so that, under the effect of increasing the temperature, the constituents of the liquid mixture will be converted to gas at different temperatures, which thus makes it possible to separate them from each other.

In particular, it is possible to separate the different constituents of a liquid air mixture and hence to isolate dinitrogen, dioxygen, but also noble gases, in particular argon.

The separation of argon from the other constituents of air in order to obtain an argon fluid which is as pure as possible is of genuine interest and has many industrial applications. Since it is an inert gas, argon is used for example as an atmosphere for certain chemical reactions. Argon is also frequently used in the manufacture of incandescent light bulbs since it has the advantage of not reacting with the filament of the light bulb.

The purity of the argon is very often characterized by the residual dioxygen content in the argon fluid obtained at the outlet of a distillation column, and improving the purity of the argon is therefore a recurring problem.

Very often, the processes and systems for improving the purity of the argon do not take into account certain criteria such as the content of dioxygen at the distillation column outlet, the delay inherent to the operation of the distillation column, external disturbances or else the bias introduced by the regulator(s) customarily used.

SUMMARY OF THE INVENTION

The present invention improves the situation.

Certain embodiments of the invention relate to a system for controlling an argon flow rate of a fluid at the outlet of an assembly of at least one distillation column in order to achieve a target dioxygen content. The system can include:

- a sensor designed to measure a dioxygen content in a fluid comprising argon at the outlet of the assembly of at least one distillation column,

- a regulator designed to determine a required argon flow rate variation depending on the difference between the dioxygen content measured by the sensor and a target dioxygen content,
- a controller designed to generate a control signal relating to a target argon flow rate, said target argon flow rate being determined depending on the required argon flow rate variation determined by the regulator and on variations in the dioxygen content measured by the sensor, and
- a valve controlled by said controller and designed to modify the argon flow rate of the fluid at the outlet of the assembly of at least one distillation column in order to obtain the target argon flow rate.

The variations of the flow rate of the fluid comprising argon at the outlet of the assembly of at least one distillation column in fact have a direct impact on the dioxygen content of this fluid. Thus, the system described here determines an argon flow rate, that is to say the target argon flow rate, for achieving the target dioxygen content.

In one or more embodiments, the assembly of at least one distillation column is supplied with an air fluid, the target argon flow rate determined by the controller being determined additionally depending on a predictive value of the argon flow rate depending on the air flow rate at the inlet of the assembly of at least one distillation column and on a yield of said assembly.

According to one aspect of the invention, the predictive value of the argon flow rate depends on an air flow rate which is delayed relative to the air flow rate at the inlet of the assembly of at least one distillation column, said delayed air being defined as follows:

$$Q^*_{air}(t)=Q_{air}(t) \text{ while } Q_{air}(t)-Q_{air}(t-\delta)<R$$

$$\text{if, at } t=t_0, R\leq Q_{air}(t_0)-Q_{air}(t_0-\delta), \text{then:}$$

$$Q^*_{air}(t)=Q_{air}(t_0-\lambda) \text{ for all } t\in[t_0;t_0+\lambda[$$

where:

- $Q^*_{air}(t)$ is the delayed flow rate at time t,
- $Q_{air}(t)$ is the air flow rate at the inlet of the assembly of at least one distillation column at time t,
- $t_0$ is any time,
- $\lambda$ and $\delta$ are predetermined periods of time,
- R is a predetermined positive threshold.

According to another aspect of the invention, the predictive value of the argon flow rate at a given time is determined as follows:

$$Q_{pred}(t)Q^*_{air}(t)\times\alpha\times\rho$$

where:

- $Q_{pred}(t)$ is the predictive value of the argon flow rate at a given time t,
- $\alpha$ is the proportion of argon in the air flow at the inlet of the assembly of at least one distillation column,
- $\rho$ is the yield of the assembly of at least one distillation column.

According to another aspect of the invention, the yield of the assembly of at least one distillation column is determined by applying a predetermined function to a factor characterizing an amount of energy used for operating the assembly of at least one distillation column.

According to another aspect of the invention, the predetermined function is determined by a learning algorithm on the basis of a set of data relating to a plurality of distillation processes implemented according to different values for the amount of energy used.

According to another aspect of the invention, the predetermined function is polynomial.

In one or more embodiments, the target argon flow rate is determined depending on an anticipation parameter relating to the variations in the dioxygen content measured by the sensor, said anticipation parameter taking discrete values within a set of predetermined values.

As explained above, the dioxygen content measured by the sensor is that of the fluid comprising argon at the outlet of the assembly of at least at least one distillation column. This fluid thus comes from the upper portion of a distillation column, where the dioxygen content varies in a non-linear manner. The regulator, more particularly a PID controller, is not suited to non-linearity and hence does not make it possible to satisfactorily regulate the dioxygen content at the outlet of the assembly of at least one distillation column. Thus, such an anticipation parameter is complementary to the regulator and therefore corrects the approximations due to the non-linearity of the dioxygen content in the upper portion of a distillation column.

According to one aspect of the invention, the anticipation parameter relating to the variations in the dioxygen content is defined as follows:

$$P(t) = \begin{cases} P_1 \text{ if } |PV(t) - PV(t-\tau)| \leq S \\ P_2 \text{ if } PV(t) - PV(t-\tau) > S \\ P_3 \text{ if } PV(t) - PV(t-\tau) < -S \end{cases}$$

where:

P(t) is the value of the anticipation parameter relating to the variations in the dioxygen content measured by the sensor at time t, $P_1$, $P_2$, $P_3$ are possible values of the anticipation parameter according to the variations in the dioxygen content measured by the sensor, PV(t) is the value of the dioxygen content measured by the sensor at time t, $\tau$ is a predetermined period of time, and S is a predetermined threshold.

The variations in the dioxygen content when the latter is regulated by a regulator, and more specifically a PID controller, are known in advance and therefore make it possible to determine the possible values of the anticipation parameter.

According to another aspect of the invention, the anticipation parameter relating to the variations in the dioxygen content measured by the sensor is a corrective flow rate, the target argon flow rate being determined as follows:

$$Q_{argon} = Q_{pred} + \Delta_{regul} + P$$

where:

$Q_{argon}$ is the target argon flow rate, $Q_{pred}$ is the predictive value of the argon flow rate, $\Delta_{regul}$ is a required argon flow rate variation, and P is the value of the corrective flow rate.

According to another aspect of the invention, the anticipation parameter relating to the variations in the dioxygen content measured by the sensor is a weighting coefficient of the predictive value of the argon flow rate, the target argon flow rate being determined as follows:

$$Q_{argon} = Q_{pred} \times P + \Delta_{regul}$$

where:

$Q_{argon}$ is the target argon flow rate, $Q_{pred}$ is the predictive value of the argon flow rate, $\Delta_{regul}$ is a required argon flow rate variation, and P is the value of the weighting coefficient of the predictive value of the argon flow rate.

In one or more embodiments, the argon flow rate predictive value is weighted by a corrective factor relating to disturbances of the assembly of at least one distillation column, said corrective factor being determined depending on the difference between the dioxygen content measured by the sensor and the target dioxygen content.

According to one aspect of the invention, the corrective factor is defined as follows:

$$K = \begin{cases} K_1 \text{ if } PV(t) - SP \geq T_1 \\ K_2 \text{ if } T_2 < PV(t) - SP < T_1 \\ K_3 \text{ if } PV(t) - SP \leq T_2 \end{cases}$$

where:

$K_1$, $K_2$ and $K_3$ are predetermined possible values of the corrective factor, and $T_1$ and $T_2$ are predetermined thresholds.

In one or more embodiments, the regulator is a PID ("proportional-integral-derivative") controller configured such that the values of the parameters respectively relating to the proportional and integral contributions of the PID controller are multiplied by two when the dioxygen content measured by the sensor is greater than the target dioxygen content.

According to one aspect of the invention, the PID controller is a PI controller.

In one or more embodiments, the target dioxygen content of the argon fluid at the outlet of the assembly of at least one distillation column is less than 2 ppm.

Advantageously, the target dioxygen content of the argon fluid at the outlet of the assembly of at least one distillation column is between 0.9 ppm and 2 ppm.

Preferentially, the target dioxygen content of the argon fluid at the outlet of the assembly of at least one distillation column is equal to 0.9 ppm.

These values are particularly advantageous. This is because the ratio of argon recovered at the outlet of the assembly of at least one distillation column depends directly on the dioxygen content at the outlet of this assembly. A dioxygen content of 0.9 ppm represents the minimum value making it possible to achieve a maximum ratio of recovered argon between the outlet fluid from the final distillation column of the assembly and the inlet fluid for this final column.

The invention also relates to a process for controlling an argon flow rate of a fluid at the outlet of an assembly of at least one distillation column in order to achieve a target dioxygen content. The process comprises:

measuring a dioxygen content in a fluid comprising argon at the outlet of the assembly of at least one distillation column, determining a required argon flow rate variation depending on the difference between the measured dioxygen content and a target dioxygen content, determining, depending on the required argon flow rate variation and on variations in the measured dioxygen content, a target argon flow rate, and modifying the argon flow rate of the fluid at the outlet of the assembly of at least one distillation column in order to obtain the target argon flow rate.

Lastly, the invention also relates to a computer program comprising instructions for implementing the process described above when these instructions are executed by at least one processor.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims or the way in which said claims refer back to one another.

DETAILED DESCRIPTION OF THE INVENTION

Figure 1:
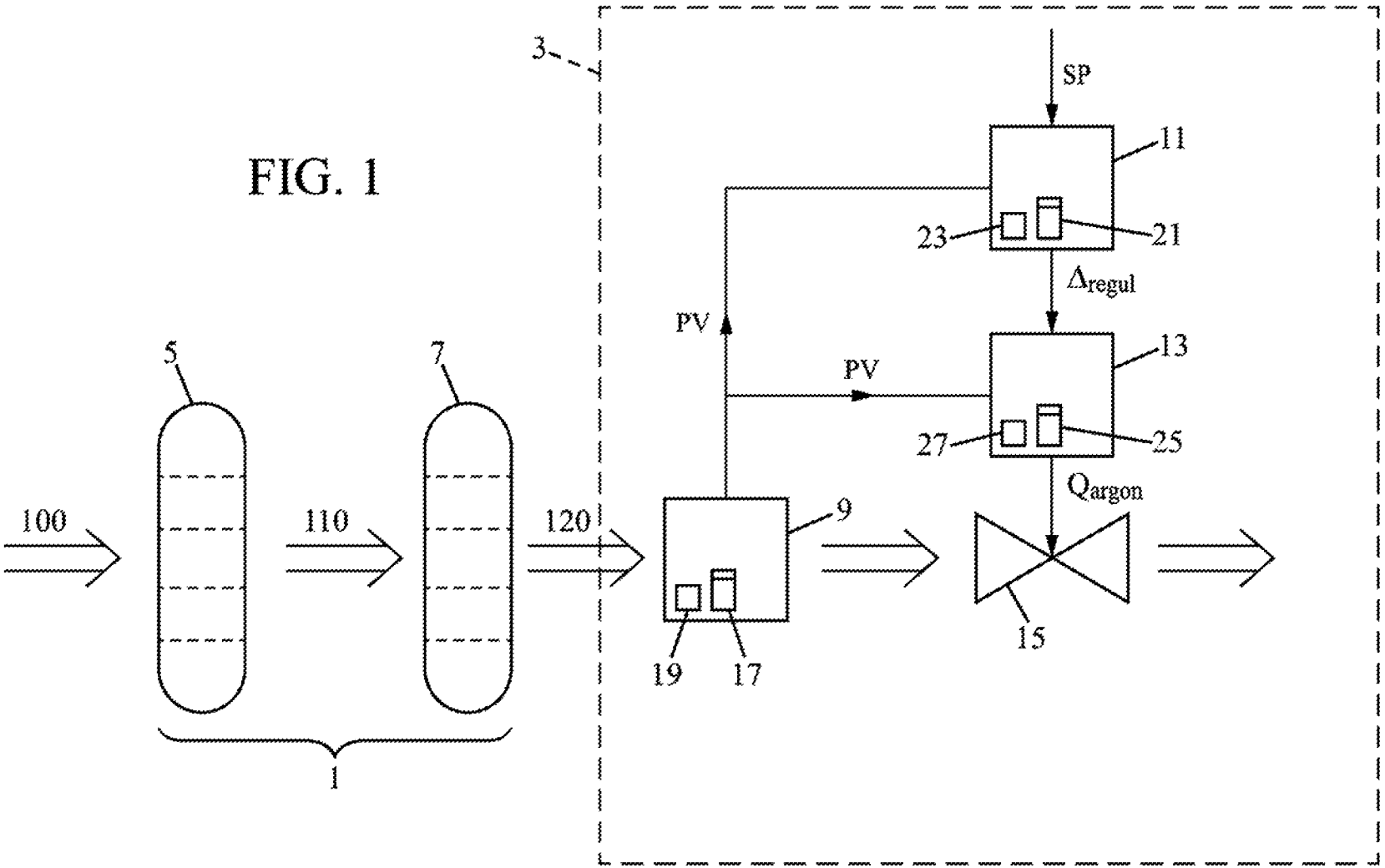
FIG. 1 illustrates an assembly of at least one distillation column and a system according to the invention comprising a sensor for measuring the dioxygen content of a fluid at the outlet of the assembly of at least one distillation column, a regulator, a controller and a valve.

FIG. 1 illustrates an assembly 1 of at least one distillation column and a system 3 for controlling an argon flow rate of a fluid at the outlet of the assembly 1.

The assembly 1 of at least one distillation column is designed to implement one or more processes for distilling a homogeneous mixture one of the constituents of which is argon (chemical element denoted "Ar" in the periodic table of the elements).

Typically, the assembly 1 comprises a plurality of successive distillation columns, each implementing a distillation process, so that the fluid at the inlet of one distillation column is the outlet fluid from the preceding distillation column. In addition, the assembly 1 is fed, for example, with an air fluid. Specifically, the air comprises argon. The argon content in the air is approximately 0.93%. It is thus understood that this air fluid is injected as input into the first distillation column 5 of the assembly 1 of at least one distillation column. Of course, other homogeneous mixtures comprising argon can be used as input for the assembly 1.

In the example illustrated in FIG. 1, the assembly 1 comprises two distillation columns, namely a first distillation column 5 and a second distillation column 7.

Figure 2:
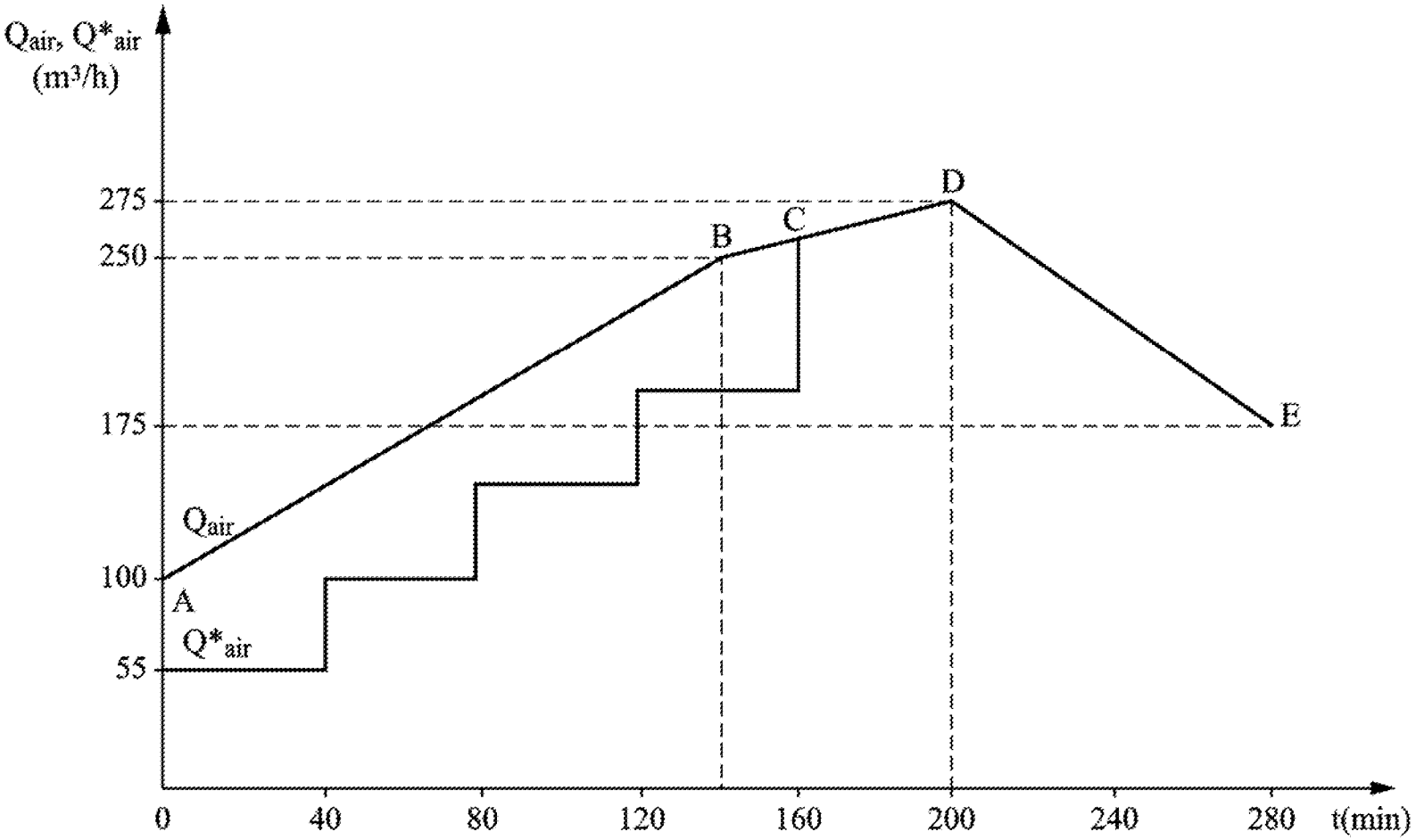
FIG. 2 illustrates the variations in the flow rate of an air fluid at the inlet of the assembly of at least one distillation column and also the variations in a delayed air flow rate used by the controller to determine a target argon flow rate of the fluid at the outlet of the assembly of at least one distillation column.

The first distillation column 5 is designed to be supplied with an air stream 100 characterized by an air flow rate $Q_{air}$. In addition, the air flow rate $Q_{air}$ of this fluid can be variable over time. By way of example, FIG. 2 illustrates variations in the air flow rate $Q_{air}$ at the inlet of the assembly 1 of at least one distillation column, and more precisely at the inlet of the first distillation column 5. In the example illustrated in FIG. 2, the air flow rate $Q_{air}$ increases with a high slope between t=0 minutes and t=140 minutes. Then, between t=140 minutes and t=200 minutes, the air flow rate $Q_{air}$ continues to increase, but with a shallow slope. Finally, the air flow rate $Q_{air}$ decreases between $\tau$=200 minutes and $\tau$=280 minutes.

The first distillation column 5 is furthermore designed to implement a distillation process so as to output a fluid 110 at the outlet. This fluid 110 has a higher argon content than the air fluid 100 at the inlet of the first distillation column 5.

The second distillation column 7 is designed to be supplied with the fluid 110. Those skilled in the art will understand that other operations which are not shown here may be carried out between two successive distillation columns. For example, the fluid 110 is a gas at the outlet of the first distillation column 5 but is a liquid at the inlet of the second distillation column 7. The second distillation column 7 is furthermore designed to implement a distillation process so as to output, as illustrated in FIG. 1, a fluid 120 at the outlet. This fluid has a higher argon content than the fluid 110 at the inlet.

The system 3 is designed to control the argon flow rate of the fluid 120 at the outlet of the assembly 1 of at least one distillation column. In the case described here, the fluid 120 corresponds to the fluid at the outlet of the second distillation column 7. The control of the argon flow rate has the consequence of modifying the dioxygen content of the fluid 120.

It is thus understood here that the system 3 is in fact designed to achieve a target dioxygen content in the fluid 120 by modifying the argon flow rate of the fluid 120. In other words, the control of the argon flow rate is the lever used, by means of the system 3, to improve the purity of the argon at the outlet of the assembly 1 of at least one distillation column.

As illustrated in FIG. 1, the system 3 comprises a sensor 9, a regulator 11, a controller 13 and a valve 15.

The sensor 9 is designed to measure the dioxygen content of the fluid 120 at the outlet of the assembly 1 of at least one distillation column. Advantageously, the value PV of the dioxygen content of the fluid 120 is measured in real time. In the remainder of the description, it will therefore be possible also to use the notation PV(t) to denote the value of the dioxygen content of the fluid 120 at a given time t. Here, the sensor 9 is positioned at the outlet of the second distillation column 7. More precisely, it is therefore understood that the sensor 9 is positioned at the upper portion of the second distillation column 7, that is to say the portion of the second distillation column 7 from which the fluid 120 is extracted.

Figure 3:
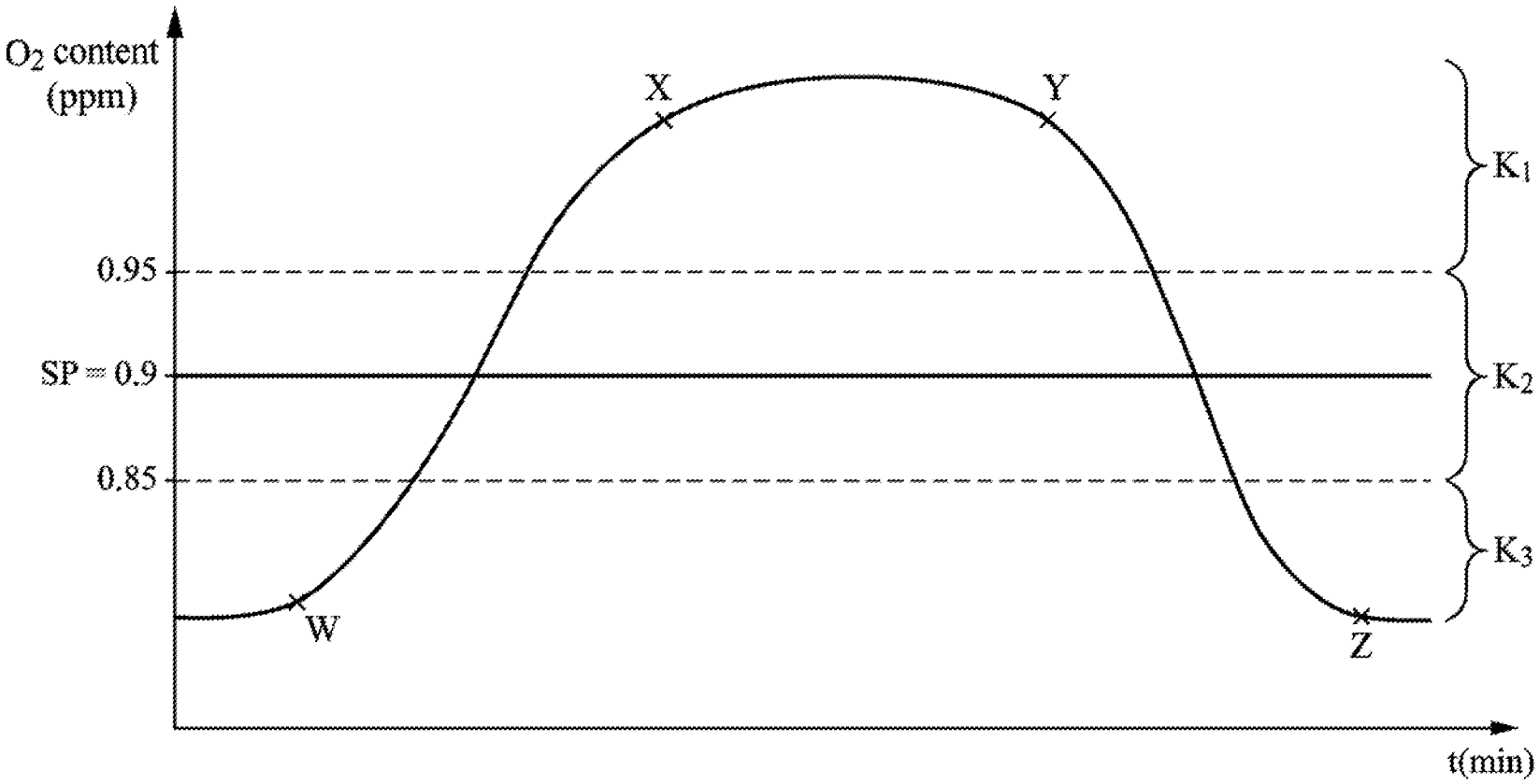
FIG. 3 illustrates variations in the dioxygen content measured by the sensor at the outlet of the assembly of at least one distillation column.

FIG. 3 illustrates an example of variations in the dioxygen content PV measured by the sensor 9 at the outlet of the assembly 1 of at least one distillation column.

The sensor 9 is designed in addition to transmit the dioxygen content value PV(t) measured at the regulator 11 at time t. Advantageously, the sensor 9 is also designed to transmit the measured dioxygen content value PV(t) to the controller 13.

The sensor 9 includes a memory 17 and a processor 19.

The memory 17 is configured to store instructions which when executed by the processor 19 result in the operation of the sensor 9.

Advantageously, the memory 17 is additionally designed to store data relating to the variations in the dioxygen content of the fluid 120 measured at the outlet of the assembly 1 of at least one distillation column.

The regulator 11 is designed to receive the value PV of the dioxygen content measured by the sensor 9. Advantageously, the regulator 11 receives the value PV of the dioxygen content in real time. On the other hand. the regulator 11 also receives as input a dioxygen content target value SP. In the remainder of the description, reference will also be made to the target dioxygen content SP. This target dioxygen content SP is a predetermined value corresponding to the dioxygen content desired for the fluid 120 at the outlet of the assembly 1. This target value SP can also be described as a setpoint.

In one or more embodiments, the target dioxygen level is less than or equal to 2 ppm. Advantageously, the target dioxygen content is between 0.9 ppm and 2 ppm. Preferentially, the target dioxygen content is equal to 0.9 ppm.

The regulator 11 is furthermore designed to determine a required argon flow rate variation $\Delta_{regul}$ depending on the difference between the dioxygen content PV measured by the sensor 11 and the target dioxygen content SP. The output of the regulator 11 is therefore a flow rate corresponding to a required variation in argon flow rate.

In addition, the regulator 11 is furthermore designed to transmit the required argon flow rate variation $\Delta_{regul}$ to the controller 13.

According to one or more embodiments, the regulator 11 is a PID ("proportional-integral-derivative") controller. This case is illustrated in FIG. 4.

Figure 4:
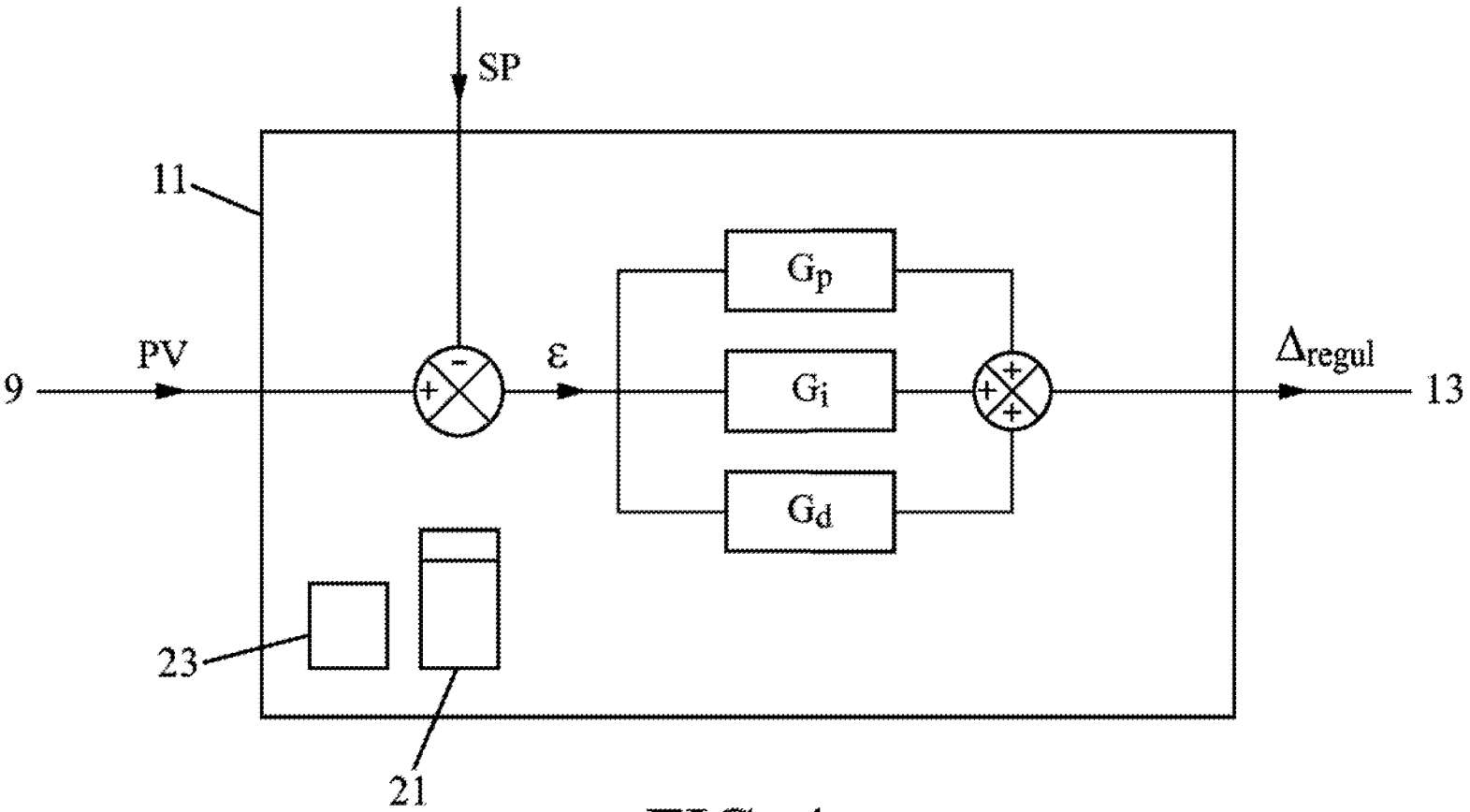
FIG. 4 illustrates the regulator according to an embodiment in which the regulator is of the PID controller type.

As illustrated in FIG. 4 in the form of a flow diagram (or block diagram), the regulator 11 receives as input a dioxygen content value PV measured by the sensor 9 and also a dioxygen content target value SP. The regulator 11 is then designed to measure the difference F between the measured dioxygen content PV and the target dioxygen content SP, i.e. $\varepsilon$=PV−SP.

In the embodiment described here, the regulator 11 is moreover designed to determine a proportional response, an integral response and a derivative response to the difference F. In other words, the required argon flow rate variation $\Delta_{regul}$ takes the following form, after application of the Laplace transform:

$$\Delta_{regul}(p) = \left[G_p \times p + \frac{G_i}{p} + G_d \times p^2\right] \times \varepsilon(p)$$

It is known in addition that the determination of the output of a PID controller may include other operations in addition to the determination of the proportional, integral and derivative responses.

Advantageously, the regulator 11 is configured so that the values of the parameters $G_p$ and $G_i$ respectively relating to the proportional and integral contributions of the regulator 11 are multiplied by two when the dioxygen content PV measured by the sensor 9 is greater than the target dioxygen content SP. In other words, by adopting the notations $G_p^+$ and $G_i^+$ in the case where the measured dioxygen content PV is greater than the target dioxygen content SP, and the notations $G_p^-$ and $G_i^+$ in the case where the measured dioxygen content PV is less than the target dioxygen content SP, the following is obtained:

$$G_p^+ = 2 \times G_p^-$$

$$G_i^- = 2 \times G_i^-$$

According to one embodiment, the regulator 11 is a PI ("proportional-integral") controller. In other words, in this embodiment, the regulator 11 is designed to determine a proportional response and an integral response to the difference F between the measured dioxygen content PV and the target dioxygen content SP. Another way to conceive of this embodiment is to consider that the regulator 11 is a PID controller with a derivative response of zero. In other words:

$$G_d = 0$$

Of course, those skilled in the art will understand that it is equivalent and just as relevant to measure the SP-PV difference instead of the PV-SP difference.

As illustrated in FIG. 1 and in FIG. 4, the regulator 11 includes a memory 25 and a processor 27.

The memory 25 is designed to store instructions which when executed by the processor 27 result in the operation of the regulator 11.

The controller 13 is designed to receive the required argon flow rate variation $\Delta_{regul}$ determined by the regulator 11. Furthermore, as explained above, the controller 13 is also coupled to the sensor 9 such that the controller 13 is designed in addition to receive the value PV of dioxygen content of the fluid 120 measured by the sensor 9 at the outlet of the assembly 1 of at least one distillation column. Advantageously, these data are received by the controller 13 in real time. At a given time t, the controller 13 thus receives the dioxygen content value PV(t) measured by the sensor 9 and the required argon flow rate variation $\Delta_{regul}$ (t) determined by the regulator 11.

The controller 13 is designed in addition to generate a control signal relating to a target argon flow rate $Q_{argon}$. The controller 13 is designed in addition to transmit the control signal to the valve 15. As explained above, the modification of the argon flow rate at the outlet of the assembly 1 directly impacts the dioxygen content of this fluid 120. The target argon flow rate $Q_{argon}$ determined by the controller 13 is thus determined for the purpose of achieving the target dioxygen content SP at the outlet of the assembly 1. As explained above, the dioxygen content target value SP is advantageously equal to 0.9 ppm.

Figure 5:
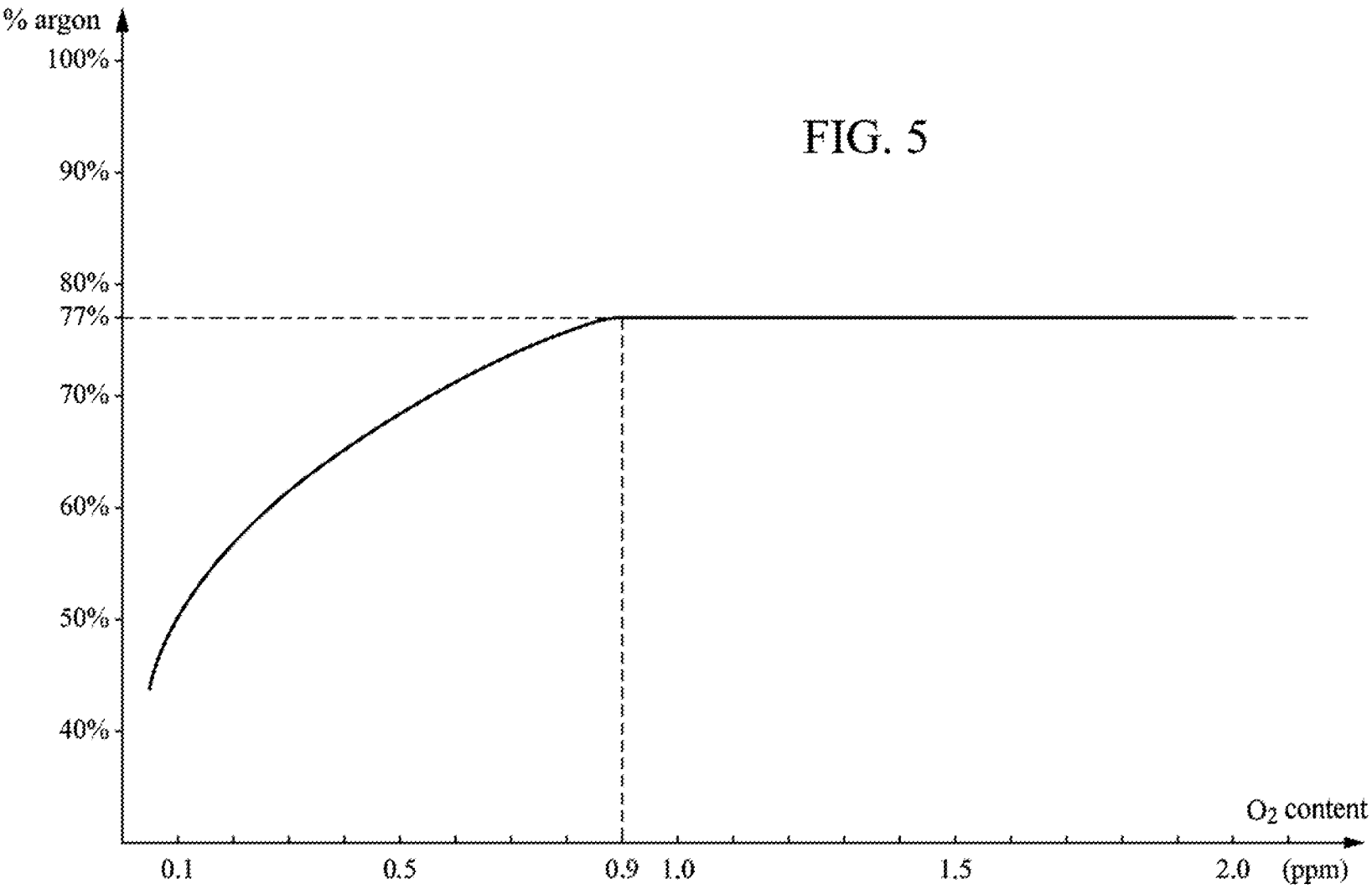
FIG. 5 illustrates the argon yield obtained as a function of the dioxygen content of the fluid at the outlet of the assembly of at least one distillation column.

The determination of the dioxygen content target value SP will now be explained with reference to FIG. 5. FIG. 5 illustrates, as a function of the dioxygen content of the fluid 120 at the outlet of the assembly 1, the amount of argon recovered, in the fluid 120, in relation to the amount of argon in the fluid 110 supplying the final distillation column of the assembly 1. In the example illustrated in FIG. 1, the final distillation column of the assembly 1 corresponds to the second distillation column 7.

In other words, FIG. 5 illustrates the ratio of argon recovered between the fluid 110 at the inlet of the final distillation column of the assembly 1 and the fluid 120 at the outlet of the final distillation column of the assembly 1. As shown, this ratio increases as the dioxygen content increases up to 0.9 ppm. From 0.9 ppm, this ratio is essentially constant. In addition, an excessively high dioxygen content in the fluid at the outlet of the assembly 1 is not desirable either since this fluid should be as pure as possible. Consequently, it is particularly advantageous to have a dioxygen content between 0.9 ppm and 2 ppm in order to achieve a maximum ratio of recovered argon, equal to 77%. Preferentially, the dioxygen content is equal to 0.9 ppm, i.e. the minimum dioxygen content value making it possible to achieve a maximum ratio of recovered argon.

The target argon flow rate $Q_{argon}$ is determined depending on the required argon flow rate variation $\Delta_{regul}$ determined by the regulator 11 and on variations in the dioxygen content PV measured by the sensor 9.

As explained above, the assembly 1 of at least one distillation column is supplied with the fluid 100 comprising argon. In the example described here, the fluid 100 is an air fluid with a flow rate which is variable over time. Advantageously, in one or more embodiments, the target argon flow rate $Q_{argon}$ determined by the controller 13 is determined additionally depending on a predictive value $Q_{pred}$ of the argon flow rate depending on the air flow rate $Q_{air}$ at the inlet of the assembly 1 of at least one distillation column and on a yield p of the assembly 1.

Advantageously, the predictive value $Q_{pred}$ of the argon flow rate depends more precisely on an air flow rate $Q^*_{air}$ which is delayed relative to the air flow rate $Q_{air}$ at the inlet of the assembly 1. It is thus understood here that, in this particular embodiment, the air flow rate value used for the determination of the predictive value $Q_{pred}$ is not the actual air flow rate $Q_{air}$ at the inlet of the assembly 1 but a delayed air flow rate $Q^*_{air}$. The use of this variable makes it possible to take into account the delay inherent to the operation of the assembly 1 in general and of the distillation columns, in this case the distillation columns 5 and 7 in particular. Thus, a modification of the air flow rate $Q_{air}$ at the inlet really only has an impact at the outlet of the assembly 1 of at least one distillation column after a certain delay, hence the advantage of using a variable, here the delayed air flow rate $Q^*_{air}$, which characterizes this delay.

Additionally, due to the small proportion of argon in air, and in particular here in the air fluid 100, it is necessary to take into consideration the time taken to "charge" the distillation column(s) of the assembly 1. Thus, the sharp increase in the air flow rate $Q_{air}$ at the inlet of the assembly 1 creates a disturbance and leads to a delay necessary for adopting the right argon purity profile within the assembly 1. Conversely, when the air flow rate at the inlet increases with a shallow slope or decreases, the argon purity profile is only slightly impacted, and it remains relevant to take into account the air flow rate $Q_{air}$ at the inlet of the assembly 1 directly, rather than to delay this flow rate.

The delayed air flow rate $Q^*_{air}$ is illustrated in FIG. 2 and will be explained in the remainder of the description.

As illustrated in FIG. 1, the controller 13 includes a memory 25 and a processor 27.

The memory 25 is designed to store instructions which when executed by the processor 27 result in the operation of the controller 13.

The valve 15 is designed to modify the argon flow rate of the fluid 120 at the outlet of the assembly 1 of at least one distillation column in order to obtain the target argon flow rate $Q_{argon}$ determined by the controller 13. As explained above, the modification of the argon flow rate of the fluid 120 induces a change in the dioxygen content of this same fluid 120. By way of example, FIG. 3 illustrates such variations in the dioxygen content.

Typically, the valve 15 includes an actuator and a pipe (not shown in FIG. 1).

The actuator is designed to modify the flow rate of the fluid, here the fluid 120 at the outlet of the assembly 1, flowing along the pipe of the valve 15 so as to obtain the desired flow rate. In the context of the invention, the position of the actuator of the valve is controlled by the control signal emitted by the controller 13. In other words, the position of the actuator depends on the target argon flow rate.

Figure 6:
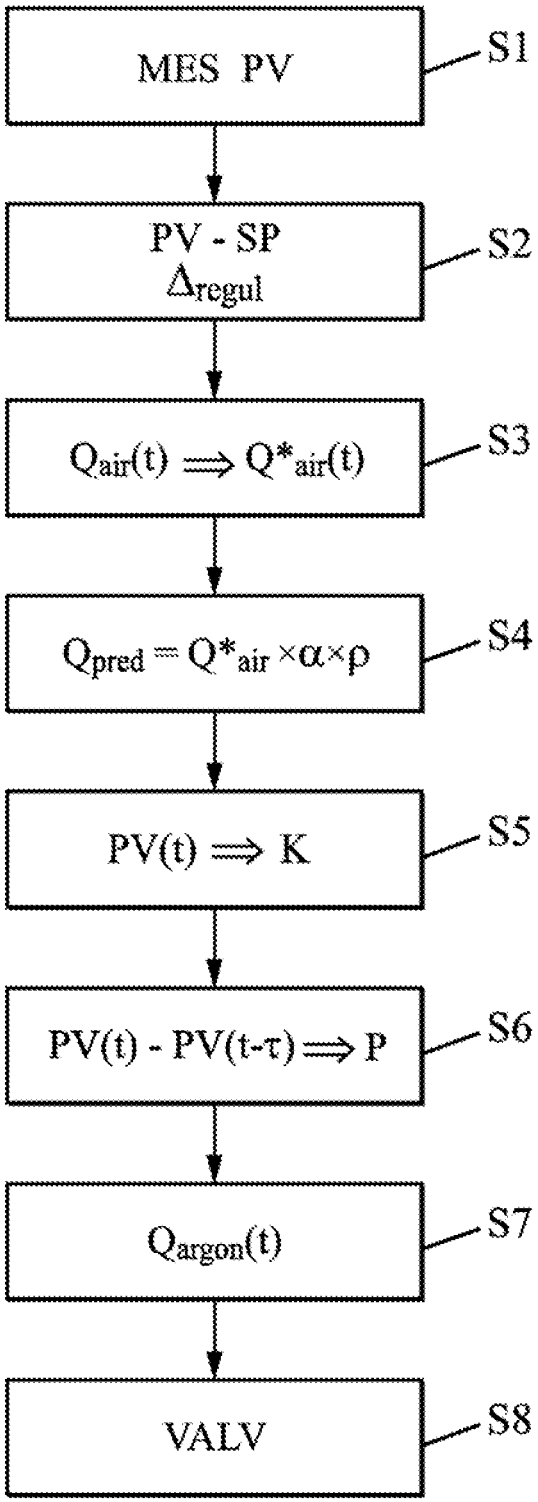
FIG. 6 illustrates a process for controlling the argon flow rate of the fluid at the outlet of the assembly of at least one distillation column according to the invention.

A process for controlling the argon flow rate of the fluid 120 at the outlet of the assembly 1 of at least one distillation column will now be described with reference to FIG. 6.

The assembly 1 of at least one distillation column is supplied with the fluid 100 comprising argon. In the example elaborated upon here, the fluid 100 is an air fluid. In addition, as explained above, the air flow rate of the fluid 100 varies over the course of time. With reference to FIG. 1, a distillation process is implemented in the first distillation column 5 so as to obtain a fluid 110 the dioxygen content of which is greater than that of the fluid 100. The fluid 110 is then injected at the inlet of the second distillation column 7 within which a distillation process is also implemented. The fluid 120 at the outlet of the second distillation column 7, and thus of the assembly 1, is the fluid treated by the system 3.

During a first step S1, the sensor 9 measures the value PV(t) of the dioxygen content of the fluid 120 at a time t. The dioxygen content of the fluid 120 is advantageously measured in real time.

The value PV(t) of the dioxygen content measured by the sensor 9 is transmitted to the regulator 11 and to the controller 13.

During a second step S2, the regulator 11 receives the value PV(t) of the dioxygen content measured by the sensor 9 at time t. In addition, the regulator 11 also receives the target value SP of the target dioxygen content, that is to say the dioxygen content which satisfies the argon purity requirement of the fluid 120.

The regulator 11 determines the difference F between the measured value PV(t) of the dioxygen content and the target value SP, also called the setpoint. The regulator 11 determines, depending on the difference $\varepsilon = PV(t) - SP$, a required argon flow rate variation $\Delta_{regul}$. Moreover, since this variation itself is also determined in real time, it may also be denoted $\Delta_{regul}(t)$ in the remainder of the description in order to denote the value of the required argon flow rate variation in response to the measured value PV(t) of the dioxygen content at time t.

In the embodiment illustrated in FIG. 4, the regulator 11 is a PID controller. In this embodiment, the required argon flow rate variation $\Delta_{regul}(t)$ comprises a proportional response, an integral response and a derivative response to the difference F between the measured dioxygen content value PV(t) and the target dioxygen content value SP. Advantageously, the regulator 11 is a PI controller and the derivative response is therefore zero.

The value of the required argon flow rate variation $\Delta_{regul}(t)$ is then transmitted to the controller 13.

During a third step S3, according to one or more embodiments, the delayed air flow rate $Q^*_{air}$ is determined depending on the air flow rate $Q_{air}$. As explained above, the air flow rate $Q_{air}$ of the air fluid 100 at the inlet of the assembly 1 of at least one distillation column varies as a function of time. These variations in the air flow rate $Q_{air}$ have an impact on the argon flow rate of the fluid 120 at the outlet of the assembly 1, and hence on the dioxygen content of the fluid 120. In addition, the successively implemented distillation process(es) have a certain delay inherent to the assembly 1. By way of example, an increase in the air flow rate at the inlet of 100 $m^3/h$ will not have an impact at the outlet of the assembly 1 until after approximately 40 minutes. It is therefore advantageous to use a delayed air flow rate value $Q^*_{air}(t)$ rather than the actual air flow rate value $Q_{air}(t)$ for the calculations detailed in the remainder of the process.

For example, the delayed flow rate $Q^*_{air}$ is defined as follows depending on the actual air flow rate $Q_{air}$:

$$Q^*_{air}(t) = Q_{air}(t) \text{ while } Q_{air}(t) - Q_{air}(t-\delta) < R$$

$$\text{if, at } \tau = t_0, R \leq Q_{air}(t_0) - Q_{air}(t_0-\delta), \text{then:}$$

$$Q^*_{air}(t) = Q_{air}(t_0-\lambda) \text{ for all } t \in [t_0; t_0+\lambda[$$

where:

$Q^*_{air}(t)$ is the delayed flow rate at time t, $Q_{air}(t)$ is the air flow rate at the inlet of the assembly of at least one distillation column at time t, $t_0$ is any time, $\lambda$ and $\delta$ are predetermined periods of time, and R is a predetermined positive threshold.

In other words, in this embodiment, the delayed air flow rate $Q^*_{air}$ differs from the actual air flow rate $Q_{air}$ when the actual air flow rate $Q_{air}$ increases with a high slope, that is to say a slope greater than or equal to a predetermined value, namely here $R/\delta$. When a high slope is detected, the value of the delayed flow rate $Q_{air}(t)$ is held constant for a predetermined period of time, here denoted $\lambda$.

Reference is now made to FIG. 2, which illustrates the variations in the air flow rate $Q_{air}$ at the inlet of the assembly 1 of at least one distillation column. In the example described here, the following predetermined conditions have been defined:

$$\delta=1 \text{ min}$$

$$R=1 \text{ m}^3/\text{h}$$

$$\lambda=40 \text{ min}$$

As illustrated in FIG. 2, the actual air flow rate $Q_{air}$ increases with a steep slope, that is to say an increase of approximately 1.07 $m^3$/h each minute, between $\tau=0$ min and $\tau=140$ min. This portion of the curve of the actual air flow rate $Q_{air}$ is indicated by the ends A and B. Since the slope is steep, the delayed flow rate $Q^*_{air}$ differs from the actual air flow rate $Q_{air}$. More precisely, the delayed air flow rate $Q^*_{air}$ is delayed by 40 minutes, a period during which the value of the delayed flow rate $Q^*_{air}$ is held constant, irrespective of the variations in the actual air flow rate $Q_{air}$ over this time interval.

By way of example, at $t_0=80$ min, the measurement indicates that the increase in flow rate over 1 minute is greater than the predetermined threshold R. The value of the delayed flow rate $Q_{air}(t)$ is therefore held steady for 40 minutes, that is to say between to =80 min and $t_0+\lambda=120$ min. Furthermore, during this period of time, the value of the delayed flow rate $Q^*_{air}(t)$ is equal to $Q_{air}(t_0-\lambda)=Q_{air}(40)\approx 97.9$ $m^3$/h.

From $\tau=140$ min, the actual air flow rate $Q_{air}$ continues to increase, but with a shallow slope this time, until $\tau=200$ min. Specifically, over this interval of time delimited by the points B and C on the curve illustrated in FIG. 2, the actual air flow rate $Q_{air}$ increases by approximately 0.42 $m^3$/h each minute, which is therefore less than the predetermined threshold R=1 $m^3$/h. When the slope is shallow, the delayed flow rate $Q^*_{air}$ is therefore equal to $Q_{air}$, but only when the period of time of 40 minutes, still in progress at $\tau=140$ min, during which the value of the delayed flow rate $Q^*_{air}(t)$ is held constant, ends, that is to say at $\tau=160$ min.

Finally, on the portion of the curve delimited by the points D and E, the curve of the actual air flow rate $Q_{air}$ is decreasing and the variation in the actual air flow rate $Q_{air}$ over 1 minute remains below the predetermined threshold R=1 $m^3$/h. The delayed air flow rate $Q^*_{air}$ is therefore equal to $Q_{air}$ between $\tau=200$ min and $\tau=280$ min.

During step S3, therefore, the delayed air flow rate value $Q^*_{air}(t)$ at time t is determined. This values is for example determined by the controller 13 which thus receives, in this embodiment, the measurement of the air flow rate $Q_{air}$ at the inlet of the assembly 1 of at least one distillation column. Alternatively, the value of the delayed air $Q^*_{air}(t)$ is transmitted directly to the controller 13.

During a step S4, the controller 13 determines the predictive value $Q_{pred}(t)$ of the argon flow rate depending on the air flow rate $Q_{air}$ at the inlet of the assembly 1 of at least one distillation column and on a yield of the assembly 1. According to one embodiment, the predictive value $Q_{pred}(t)$ is more precisely determined depending not on the air flow rate $Q_{air}$ at the inlet of the assembly 1, but on the delayed air flow rate $Q^*_{air}$ and on the yield of the assembly 1.

For example, for a given time t, the predictive value $Q_{pred}(t)$ of the argon flow rate is determined by the controller 13 as follows:

$$Q_{pred}(t)=Q^*_{air}(t)\times\alpha\times\rho$$

where:

$Q_{pred}(t)$ is the predictive value of the argon flow rate at a given time t, $\alpha$ is the proportion of argon in the air flow at the inlet of the assembly of at least one distillation column, $\rho$ is the yield of the assembly of at least one distillation column.

Typically, the proportion of argon a in the air flow at the inlet of the assembly of at least one distillation column is approximately 0.93%.

Regarding the yield p of the assembly 1, this is determined for example by applying a predetermined function to a factor characterizing an amount of energy used for operating the assembly 1 of at least one distillation column.

Advantageously, the predetermined function is determined by a learning algorithm on the basis of a set of data relating to a plurality of distillation processes implemented according to different values for the amount of energy used. In other words, the predetermined function is determined by carrying out a plurality of distillation processes while varying the amount of energy used from one process to another. This then yields a set of energy amount-yield points. A learning algorithm such as an extrapolation of these different points makes it possible to determine the function F.

For example, the predetermined function is polynomial. Typically, such a predetermined function is a polynomial function of degree less than or equal to 2.

During an optional fifth step S5, the predictive value $Q_{pred}(t)$ of argon flow rate at a time t is weighted by a corrective factor K relating to disturbances of the assembly 1 of at least one distillation column. The corrective factor K is determined depending on the difference between the dioxygen content PV(t) measured by the sensor 9 and the target dioxygen content SP.

In one or more embodiments, the corrective factor K is defined as follows:

$$K=\begin{cases} K_1 \text{ if } PV(t)-SP \geq T_1 \\ K_2 \text{ if } T_2 < PV(t)-SP < T_1 \\ K_3 \text{ if } PV(t)-SP \leq T_2 \end{cases}$$

where:

$K_1$, $K_2$ and $K_3$ are predetermined possible values of the corrective factor, and $T_1$ and $T_2$ are predetermined thresholds.

Reference is now made to FIG. 3, which illustrates an example of variations in the dioxygen content PV measured by the sensor 9 at the outlet of the assembly 1. In the example described here, the following predetermined conditions have been defined:

$$SP=0.9 \text{ ppm}$$

$$T_1=0.05 \text{ ppm}$$

$$T_2=-0.05 \text{ ppm}$$

$K_1=0.75$ $K_2=0.9$ $K_3=1$

As illustrated in FIG. 3, the value of the corrective factor K is $K_1$ when the value PV(t) of the argon flow rate measured by the sensor 9 is greater than or equal to 0.95 ppm. When the value PV(t) of the argon flow rate measured by the sensor 9 is greater than 0.85 ppm and less than 0.95 ppm, the value of the corrective factor K is $K_2$. Lastly, the value of the corrective factor K is $K_3$ when the value PV(t) of the argon flow rate measured by the sensor 9 is less than or equal to 0.85 ppm.

The use of the corrective factor K to weight the predictive value $Q_{pred}$ of the argon flow rate makes it possible to take into account the significant inertia of the assembly 1 when the latter encounters external disturbances or a notable change in operation.

During a sixth step S6, an anticipation parameter P relating to the variations in the dioxygen content PV measured by the sensor 9 is determined, for example by the controller 13. The anticipation parameter P takes discrete values within a set of predetermined values.

As explained above, the system 3 uses a regulator 11 which is typically a PID controller. The use of such a regulator induces a variation in the argon flow rate of the fluid 120, namely the variation $\Delta_{regul}$ discussed so far. The change over time in the dioxygen content in the fluid 120 at the outlet of the assembly 1 has a similar profile to that of the curve illustrated in FIG. 3. Four inflection points respectively denoted W, X, Y and Z in FIG. 3 are typically observed.

As illustrated, the point W marks the start of a strong increase in the dioxygen content, while the point X marks the end of this strong increase and the start of a phase during which the dioxygen content is substantially constant. The point Y marks the start of a strong decrease in the dioxygen content, while the point Z marks the end of this strong decrease and the start of a phase during which the dioxygen content is again substantially constant. Such variations are of course bound to repeat over time.

The anticipation parameter P relating to the variations in the dioxygen content PV measured by the sensor 9 is based on the fact that these variations, largely due to the operating mode of the regulator 11, have a profile which is known in advance and which can therefore be anticipated. In addition, the PID controller is very often not suitable for regulating non-linear variations, which is the case here, as illustrated in FIG. 3, with the variations in the dioxygen content at the outlet of the assembly 1. This non-linearity is mainly due to the fact that the dioxygen content measured corresponds to the dioxygen content of the fluid 120 extracted from the upper portion of the distillation column, here the second distillation column 7. In the upper portion of the distillation column, the variations in the dioxygen content are non-linear and, therefore, the output of the regulator 11 does not make it possible to satisfactorily regulate the dioxygen content. It is thus understood that the anticipation parameter P aims to compensate for the relative inability of the regulator 11 to regulate in the case of non-linearity.

The anticipation parameter P is defined to take discrete values within a set of predetermined values depending on the current position on the curve of the measured dioxygen content PV.

For example, the anticipation parameter P relating to the variations in the dioxygen content is defined as follows:

$$P(t)=\begin{cases} P_1 \text{ if } |PV(t)-PV(t-\tau)|\leq S \\ P_2 \text{ if } PV(t)-PV(t-\tau)>S \\ P_3 \text{ if } PV(t)-PV(t-\tau)<-S \end{cases}$$

where:

P(t) is the value of the anticipation parameter relating to the variations in the dioxygen content measured by the sensor at time t, $P_1$, $P_2$, $P_3$ are possible values of the anticipation parameter according to the variations in the dioxygen content measured by the sensor, PV(t) is the value of the dioxygen content measured by the sensor at time t, $\tau$ is a predetermined period of time, and S is a predetermined threshold.

In this embodiment, the set of predetermined values thus comprises a first predetermined value $P_1$, a second predetermined value $P_2$ and a third predetermined value $P_3$.

Considering the example illustrated in FIG. 3, the anticipation parameter P takes the value $P_1$ on the portion of the curve before the point W, between the point X and the point Y, and after the point Z. The anticipation parameter P takes the value $P_2$ on the portion of the curve between the point W and the point X. Lastly, the anticipation parameter P takes the value $P_3$ on the portion of the curve between the point Y and the point Z.

In addition, this anticipation parameter can be of a different nature depending on embodiments and may thus be used differently from one embodiment to another in the determination, by the controller 13, of the target argon flow rate $Q_{argon}$.

Thus, in one embodiment, the anticipation parameter P relating to the variations in the dioxygen content PV measured by the sensor 9 is a corrective flow rate. By way of example, the discrete values by the anticipation parameter P are the following:

$P_1=0$ m³/h $P_2=-75$ m³/h $P_3=55$ m³/h

Alternatively, the anticipation parameter P relating to the variations in the dioxygen content PV measured by the sensor 9 is a weighting coefficient of the predictive value $Q_{pred}$ of the argon flow rate. By way of example, the discrete values by the anticipation parameter P are the following:

$P_1=1$ $P_2=0.95$ $P_3=1.05$

During a seventh step S7, the controller 13 determines the target argon flow rate $Q_{argon}$. It is also understood from the above that the target argon flow rate $Q_{argon}$ is advantageously determined in real time since it depends on the required argon flow rate variation $\Delta_{regul}$ determined by the regulator and on variations in the dioxygen content PV measured by the sensor 9 in real time.

As explained above, the anticipation parameter P relating to the variations in the dioxygen content PV measured by the sensor 9 is, according to one embodiment, a corrective flow rate.

The target argon flow rate $Q_{argon}$ is then determined as follows:

$$Q_{argon}=Q_{pred}+\Delta_{regul}+P$$

where:

$Q_{argon}$ is the target argon flow rate, $Q_{pred}$ is the predictive value of the argon flow rate, $\Delta_{regul}$ is a required argon flow rate variation, and P is the value of the corrective flow rate.

In addition, in the embodiment corresponding to the optional step S5, in which a corrective factor K is determined, the argon flow rate $Q_{argon}$ is determined as follows:

$$Q_{argon}=K\times Q_{pred}+\Delta_{regul}+P$$

Alternatively, the anticipation parameter P relating to the variations in the dioxygen content PV measured by the sensor 9 is a weighting coefficient of the predictive value $Q_{pred}$ of the argon flow rate.

The target argon flow rate $Q_{argon}$ is then determined as follows:

$$Q_{argon}=Q_{pred}\times P+\Delta_{regul}$$

where:

$Q_{argon}$ is the target argon flow rate, $Q_{pred}$ is the predictive value of the argon flow rate, $\Delta_{regul}$ is a required argon flow rate variation, and P is the value of the weighting coefficient of the predictive value of the argon flow rate.

In combination with the embodiment in which a corrective factor K is determined, the argon flow rate $Q_{argon}$ is determined as follows:

$$Q_{argon}=K\times Q_{pred}\times P+\Delta_{regul}$$

The controller 13 then generates a control signal to the target argon flow rate $Q_{argon}$ determined. This control signal is sent to the valve 15 of the system 3.

During an eighth step S8, the valve 15 receives the control signal sent by the controller 13. This control signal is characteristic of the target argon flow rate $Q_{argon}$. On receipt of this control signal, the position of the actuator of the valve 15 is modified so that the flow rate of the fluid 120, flowing in the pipe of the valve 15, achieves the target argon flow rate $Q_{argon}$. The modification, with the aid of the valve 15 controlled by the controller 13, makes it possible to directly impact the dioxygen content of the fluid 120 in order to achieve the target dioxygen content SP. As explained above, the target dioxygen content is typically less than 2 ppm, preferentially equal to 0.9 ppm.

The present invention has a number of advantages.

First of all, the use of the dioxygen content value measured at the outlet of the assembly of at least one distillation column makes it possible to have more relevant data for determining the argon flow rate making it possible to achieve the target dioxygen content.

Taking into account the significant inertia of the distillation process and of the delay required for the assembly of at least one distillation column to reflect at the outlet the variations in the air flow rate at the inlet or the modification of the setpoint also make it possible to improve the determination of the target argon flow rate by anticipating the conditions of the distillation process.

Lastly, the anticipation parameter makes it possible to anticipate the variations in the dioxygen content which are induced by the use of a regulator, and more specifically a PID controller, and hence to more rapidly and more reliably achieve the target dioxygen content. This anticipation parameter thus makes it possible to compensate the bias introduced by the use of a regulator. In addition, the dioxygen content used here is non-linear since it is measured on the outlet fluid, and hence the fluid coming from the upper portion of a distillation column. A regulator, and more specifically a PID controller, is not suitable for managing this non-linearity, hence the use of the anticipation parameter in addition to the regulator, this anticipation parameter being suitable for the non-linearity of the dioxygen content of the outlet fluid of the assembly of at least one distillation column.

Typically, for all of the figures, the column 5 is a double column for air separation comprising a medium-pressure column thermally coupled to a low-pressure column, the low-pressure column being supplied with a nitrogen-enriched fluid and an oxygen-enriched fluid originating from the medium-pressure column. The flow 110 is a flow enriched in argon originating from the low-pressure column, which is sent to the argon column 7. The argon-rich fluid 120 is produced by the argon column 7.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A system for controlling an argon flow rate of a fluid at an outlet of an assembly of at least one distillation column in order to achieve a target dioxygen content (SP), the system comprising:

a. a sensor configured to measure a dioxygen content (PV) in a fluid comprising argon at the outlet of the assembly of at least one distillation column;

b. a regulator configured to determine a required argon flow rate variation ($\Delta_{regul}$) depending on the difference (c) between the dioxygen content measured by the sensor and a target dioxygen content;

c. a controller configured to generate a control signal relating to a target argon flow rate ($Q_{argon}$), said target argon flow rate being determined depending on the required argon flow rate variation determined by the regulator and on variations in the dioxygen content measured by the sensor; and d. a valve controlled by said controller and configured to modify the argon flow rate of the fluid at the outlet of the assembly of at least one distillation column in order to obtain the target argon flow rate, wherein the assembly of at least one distillation column is supplied with an air fluid, the target argon flow rate determined by the controller being determined additionally depending on a predictive value ($Q_{pred}$) of the argon flow rate depending on the air flow rate ($Q_{air}$) at the inlet of the assembly of at least one distillation column and on a yield (ρ) of said assembly, wherein controller is further configured to weight the argon flow rate predictive value ($Q_{pred}$) by a corrective factor (K) relating to disturbances of the assembly of at least one distillation column, said corrective factor being determined depending on the difference between the dioxygen content measured by the sensor and the target dioxygen content.

2. The system as claimed in claim 1, wherein the predictive value of the argon flow rate depends on an air flow rate ($Q^*_{air}$) which is delayed relative to the air flow rate at the inlet of the assembly of at least one distillation column, said delayed air flow rate being defined as follows:

$$Q^*_{air}(t)=Q_{air}(t) \text{ while } Q_{air}(t)-Q_{air}(t-\delta)<R$$

if, at $t=t_0$, $R\leq Q_{air}(t_0)-Q_{air}(t_0-\delta)$, then:

$$Q^*_{air}(t)=Q_{air}(t_0-\lambda) \text{ for all } t\in[t_0;t_0+\lambda]$$

where:

$Q^*_{air}(t)$ is the delayed flow rate at time t, $Q_{air}(t)$ is the air flow rate at the inlet of the assembly of at least one distillation column at time t, $t_0$ is any time, λ and δ are predetermined periods of time, R is a predetermined positive threshold.

3. The system as claimed in claim 2, wherein the predictive value of the argon flow rate at a given time is determined as follows:

$$Q_{pred}(t)=Q^*_{air}(t)\times\alpha\times\rho$$

where:

$Q_{pred}(t)$ is the predictive value of the argon flow rate at a given time t,

α is the proportion of argon in the air flow at the inlet of the assembly of at least one distillation column, ρ is the yield of the assembly of at least one distillation column.

4. The system as claimed in claim 1, wherein the yield of the assembly of at least one distillation column is determined by applying a predetermined function to a factor characterizing an amount of energy used for operating the assembly of at least one distillation column.

5. The system as claimed in claim 4, wherein the predetermined function is determined by a learning algorithm on the basis of a set of data relating to a plurality of distillation processes implemented according to different values for the amount of energy used.

6. The system as claimed in claim 5, wherein the predetermined function is polynomial.

7. The system as claimed in claim 1, wherein the target argon flow rate is determined depending on an anticipation parameter (P) relating to the variations in the dioxygen content measured by the sensor, said anticipation parameter taking discrete values within a set of predetermined values.

8. The system as claimed in claim 7, wherein the anticipation parameter relating to the variations in the dioxygen content is defined as follows:

$$P(t)=\begin{cases} P_1 \text{ if } |PV(t)-PV(t-\tau)|\leq S \\ P_2 \text{ if } PV(t)-PV(t-\tau)>S \\ P_3 \text{ if } PV(t)-PV(t-\tau)<-S \end{cases}$$

where:

P(t) is the value of the anticipation parameter relating to the variations in the dioxygen content measured by the sensor at time t, $P_1$, $P_2$, $P_3$ are possible values of the anticipation parameter according to the variations in the dioxygen content measured by the sensor, PV(t) is the value of the dioxygen content measured by the sensor at time t, τ is a predetermined period of time, and S is a predetermined threshold.

9. The system as claimed in claim 8, wherein the assembly of at least one distillation column is supplied with the air fluid, the target argon flow rate determined by the controller being determined additionally depending on a predictive value ($Q_{pred}$) of the argon flow rate depending on the air flow rate ($Q_{air}$) at the inlet of the assembly of at least one distillation column and on a yield (ρ) of said assembly, wherein the anticipation parameter relating to the variations in the dioxygen content measured by the sensor is a corrective flow rate, the target argon flow rate being determined as follows:

$$Q_{argon}=Q_{pred}+\Delta_{regul}+P$$

where:

$Q_{argon}$ is the target argon flow rate, $Q_{pred}$ is the predictive value of the argon flow rate, $\Delta_{regul}$ is a required argon flow rate variation, and P is the value of the corrective flow rate.

10. The system as claimed in claim 8, wherein the assembly of at least one distillation column is supplied with the air fluid, the target argon flow rate determined by the controller being determined additionally depending on a predictive value ($Q_{pred}$) of the argon flow rate depending on the air flow rate ($Q_{air}$) at the inlet of the assembly of at least one distillation column and on a yield (ρ) of said assembly, wherein the anticipation parameter relating to the variations in the dioxygen content measured by the sensor is a weighting coefficient of the predictive value of the argon flow rate, the target argon flow rate being determined as follows:

$$Q_{argon}=Q_{pred}\times P+\Delta_{regul}$$

Where:

$Q_{argon}$ is the target argon flow rate, $Q_{pred}$ is the predictive value of the argon flow rate, $\Delta_{regul}$ is a required argon flow rate variation, and P is the value of the weighting coefficient of the predictive value of the argon flow rate.

11. The system as claimed in claim 1, wherein the corrective factor is defined as follows:

$$K = \begin{cases} K_1 \text{ if } PV(t) - SP \geq T_1 \\ K_2 \text{ if } T_2 < PV(t) - SP < T_1 \\ K_3 \text{ if } PV(t) - SP \leq T_2 \end{cases}$$

where:

$K_1$, $K_2$ and $K_3$ are predetermined possible values of the corrective factor, and $T_1$ and $T_2$ are predetermined thresholds.

12. The system as claimed in claim 1, wherein the regulator is a PID ("proportional-integral-derivative") controller configured such that values of the parameters respectively relating to the proportional and integral contributions of the PID controller are multiplied by two when the dioxygen content measured by the sensor is greater than the target dioxygen content.

13. The system as claimed in claim 12, wherein the PID controller has a derivative response of zero.

14. The system as claimed in claim 1, wherein the target dioxygen content of the argon fluid at the outlet of the assembly of at least one distillation column is less than 2 ppm.

15. The system as claimed in claim 14, wherein the target dioxygen content of the argon fluid at the outlet of the assembly of at least one distillation column is between 0.9 ppm and 2 ppm.

16. The system as claimed in claim 14, wherein the target dioxygen content of the argon fluid at the outlet of the assembly of at least one distillation column is equal to 0.9 ppm.

* * * * *